US005772036A

United States Patent [19]

Muncy et al.

[11] Patent Number: 5,772,036

[45] Date of Patent: Jun. 30, 1998

[54] ELECTRIC ACCESSORY BAG

[76] Inventors: Kimberly C. Muncy; Robert B. Muncy, both of 1035 Belhaven Dr., Russell, Ky. 41169; Walter G. Clark, 605 LaGar St., Flatwoods, Ky. 41139

[21] Appl. No.: 937,071

[22] Filed: Sep. 24, 1997

[51] Int. Cl.[6] ..... B65D 33/00

[52] U.S. Cl. ..... 206/581; 206/823; 206/702

[58] Field of Search ..... 206/581, 823, 206/320, 701, 702; 220/4.21, 4.22; 190/1

[56] References Cited

U.S. PATENT DOCUMENTS 5,025,928 6/1991 Orosy et al. .
5,330,056 7/1994 de la Rocha .

*Primary Examiner*—Jacob K. Ackun

[57] ABSTRACT

An electric accessory bag including a bag portion comprising a pair of sections hingedly coupled together. The pair of sections include a first section and a second section. The first section has a carrying handle secured to an upper end thereof. The second section has a shoulder strap secured to an upper end thereof. A retractable power cord is secured to a side wall of the first section of the bag portion. The retractable power cord has a plug end coupleable to a standard electrical outlet. The retractable power cord has a cord portion extending interiorly of the bag portion. A power strip is disposed within the first section of the bag portion. The power strip is in communication with the cord portion of the retractable power cord.

10 Claims, 3 Drawing Sheets

FIG. 1
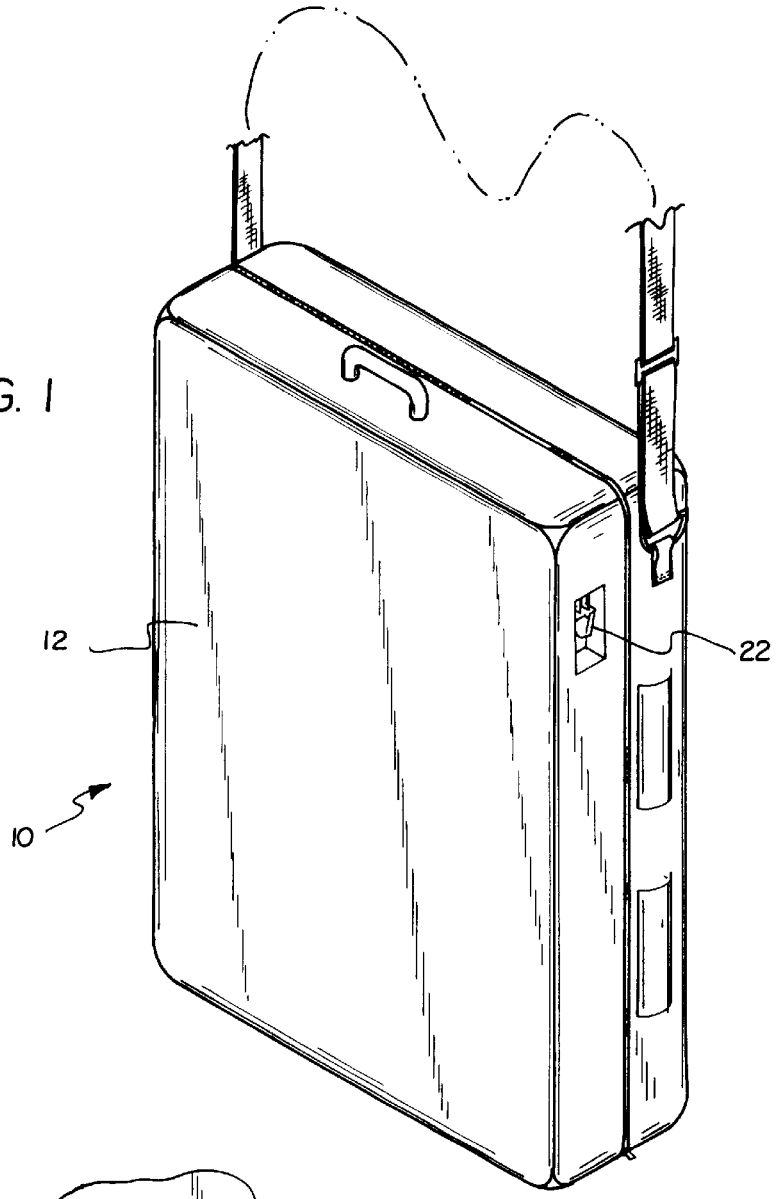
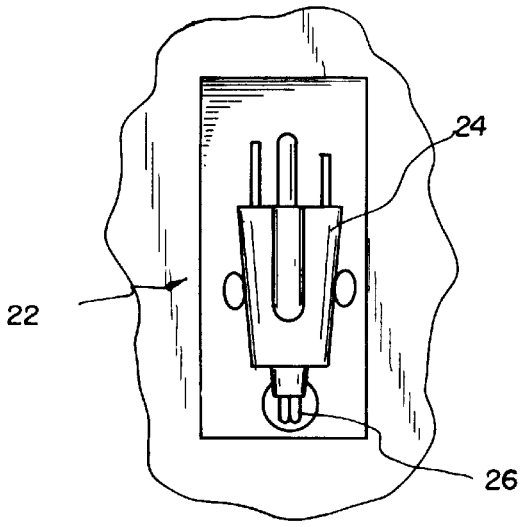
FIG. 2

ELECTRIC ACCESSORY BAG

BACKGROUND OF THE INVENTION

1. Field of the Invention

The present invention relates to an electric accessory bag and more particularly pertains to storing a plurality of appliances and toiletries for easy use with an electric accessory bag.

2. Description of the Prior Art

The use of cosmetic bags is known in the prior art. More specifically, cosmetic bags heretofore devised and utilized for the purpose of storing cosmetics are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 348,754 to Feller; U.S. Pat. No. Des. 358,482 to Taguchi et al.; U.S. Pat. No. 4,960,204 to Young et al.; U.S. Pat. No. 5,238,305 to Feller; U.S. Pat. No. 5,431,265 to Yoo; and U.S. Pat. No. Des. 345,255.

While these devices fulfill their respective, particular objective and requirements, the aforementioned patents do not describe an electric accessory bag for storing a plurality of appliances and toiletries for easy use.

In this respect, the electric accessory bag according to the present invention substantially departs from the conventional concepts and designs of the prior art, and in doing so provides an apparatus primarily developed for the purpose of storing a plurality of appliances and toiletries for easy use.

Therefore, it can be appreciated that there exists a continuing need for new and improved electric accessory bag which can be used for storing a plurality of appliances and toiletries for easy use. In this regard, the present invention substantially fulfills this need.

SUMMARY OF THE INVENTION

In the view of the foregoing disadvantages inherent in the known types of cosmetic bags now present in the prior art, the present invention provides an improved electric accessory bag. As such, the general purpose of the present invention, which will be described subsequently in greater detail, is to provide a new and improved electric accessory bag and method which has all the advantages of the prior art and none of the disadvantages.

To attain this, the present invention essentially comprises a bag portion comprising a pair of sections hingedly coupled together. The pair of sections include a first section and a second section. The first section has a carrying handle secured to an upper end thereof. The second section has a shoulder strap secured to an upper end thereof. A retractable power cord is secured to a side wall of the first section of the bag portion. The retractable power cord has a plug end coupleable to a standard electrical outlet. The retractable power cord has a cord portion extending interiorly of the bag portion. A power strip is disposed within the first section of the bag portion. The power strip is in communication with the cord portion of the retractable power cord. A plurality of receiving pouches are disposed within the first section of the bag portion. The receiving pouches have varying sizes and shapes. The receiving pouches are adapted for holding toiletries and small appliances therein. A plurality of large inverted U-shaped loops are secured within the first section of the bag portion. The loops are adapted for holding bottles.

A plurality of small inverted U-shaped loops are secured within the first section of the bag portion. The small loops are adapted for holding toothbrushes and make-up brushes. A light is secured within the second section of the bag portion. The light is in communication with the cord portion of the retractable power cord. A mirror is disposed within the second section of the bag portion. A tissue dispenser is disposed within the second section of the bag portion. A holding clip is disposed within the second section of the bag portion. The holding clip is adapted for holding a plurality of cotton swabs. A folding shelf is secured within the second section of the bag portion. The shelf has a first orientation essentially parallel to the second section and a second orientation essentially orthogonal to the second section.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electric accessory bag which has all the advantages of the prior art cosmetic bags and none of the disadvantages.

It is another object of the present invention to provide a new and improved electric accessory bag which may be easily and efficiently manufactured and marketed.

It is a further object of the present invention to provide a new and improved electric accessory bag which is of durable and reliable construction.

An even further object of the present invention is to provide a new and improved electric accessory bag which is susceptible of a low cost of manufacture with regard to both materials and labor, and which accordingly is then susceptible of low prices of sale to the consuming public, thereby making such an electric accessory bag economically available to the buying public.

Even still another object of the present invention is to provide a new and improved electric accessory bag for storing a plurality of appliances and toiletries for easy use.

Lastly, it is an object of the present invention to provide a new and improved electric accessory bag including a bag portion comprising a pair of sections hingedly coupled together. The pair of sections include a first section and a second section. The first section has a carrying handle secured to an upper end thereof. The second section has a shoulder strap secured to an upper end thereof. A retractable power cord is secured to a side wall of the first section of the bag portion. The retractable power cord has a plug end coupleable to a standard electrical outlet. The retractable power cord has a cord portion extending interiorly of the bag portion. A power strip is disposed within the first section of the bag portion. The power strip is in communication with the cord portion of the retractable power cord.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the electric accessory bag constructed in accordance with the principles of the present invention.

FIG. 2 is a side view of the present invention illustrating the retractable power cord thereof.

The same reference numerals refer to the same parts through the various figures.

DESCRIPTION OF THE PREFERRED EMBODIMENT

Figure 3:
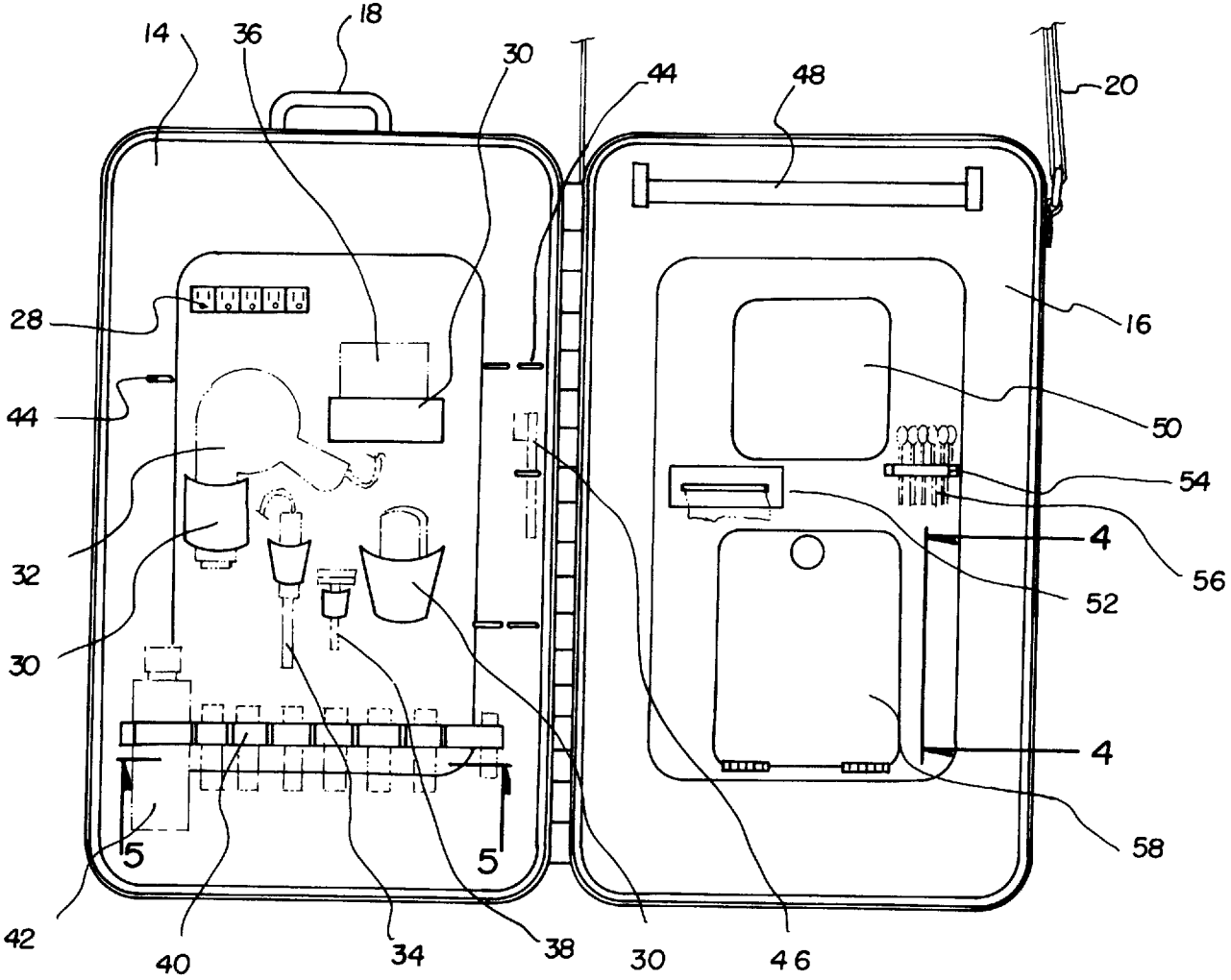
FIG. 3 is plan view of the interior of the present invention.
Figure 4:
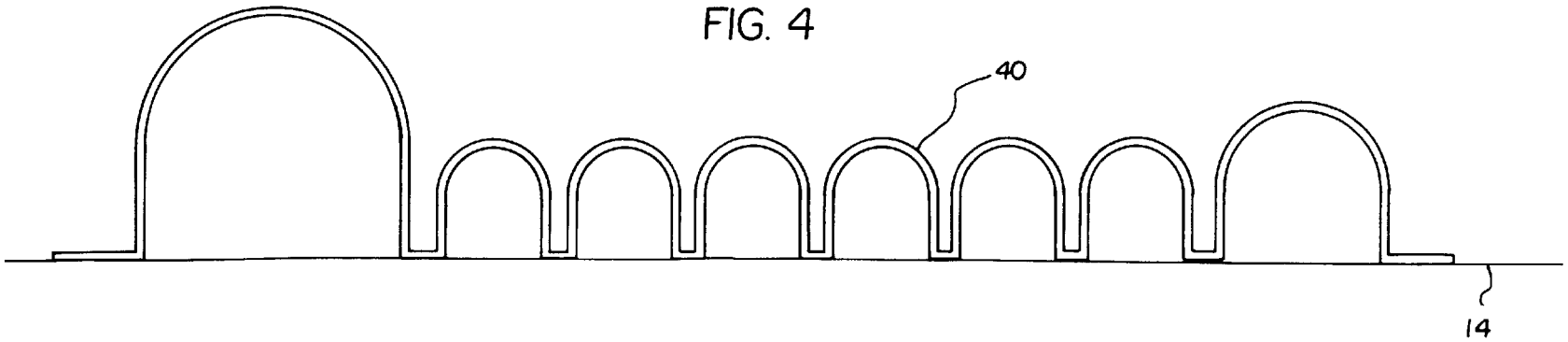
FIG. 4 is cross-sectional view as taken along line 4—4 of FIG. 3.
Figure 5:
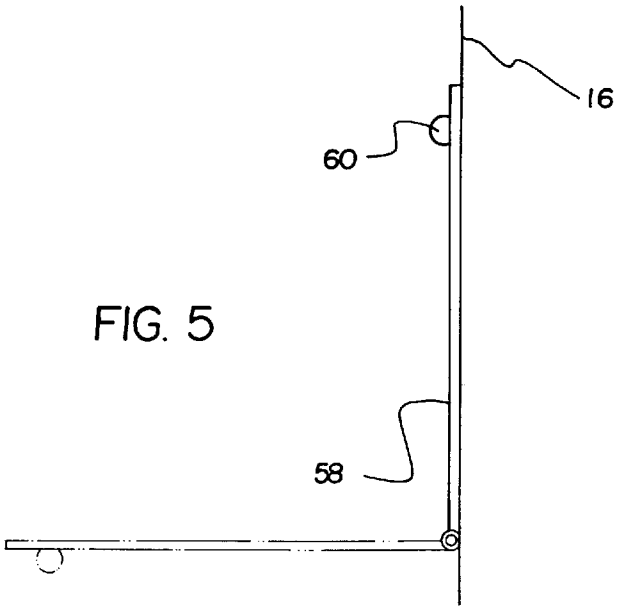
FIG. 5 is cross-sectional view as taken along line 5—5 of FIG. 3.

With reference now to the drawings, and in particular, to FIGS. 1 through 5 thereof, the preferred embodiment of the new and improved electric accessory bag embodying the principles and concepts of the present invention and generally designated by the reference number 10 will be described.

Specifically, it will be noted in the various Figures that the device relates to an electric accessory bag for storing a plurality of appliances and toiletries for easy use. In its broadest context, the device consists of a bag portion, a retractable power cord, a power strip, a plurality of receiving pouches, a plurality of large inverted U-shaped loops, a plurality of small inverted U-shaped loops, a light, a mirror, a tissue dispenser, a holding clip, and a folding tray. Such components are individually configured and correlated with respect to each other so as to attain the desired objective.

The bag portion 12 comprises a pair of sections hingedly coupled together. The pair of sections include a first section 14 and a second section 16. The first section 14 has a carrying handle 18 secured to an upper end thereof. The second section 16 has a shoulder strap 20 secured to an upper end thereof. The shoulder strap 20 can be adjustable. The bag portion 12 will also include some type of closure, such as a zipper or snaps.

The retractable power cord 22 is secured to a side wall of the first section 14 of the bag portion 12. The retractable power cord 22 has a plug end 24 coupleable to a standard electrical outlet. The retractable power cord 22 has a cord portion 26 extending interiorly of the bag portion 12.

The power strip 28 is disposed within the first section 14 of the bag portion 12. The power strip 28. is in communication with the cord portion 26 of the retractable power cord 22. The power strip 28 provides a plurality of outlets for receiving the plugs of the electrical accessories that will be used in association with the present invention. The power strip 28 will receive power once the plug end 24 is coupled with a working electrical outlet.

The plurality of receiving pouches 30 are disposed within the first section 14 of the bag portion 12. The receiving pouches 30 have varying sizes and shapes. Note FIG. 3. The receiving pouches 30 are adapted for holding toiletries and small appliances therein. The receiving pouches 30 are specifically designed for holding hair dryers 32, curling irons 34, first aid kits 36 and razors 38. The receiving pouches 30 could be either formed of a flexible canvas material or of a rigid molded plastic or a combination of both whereby some of the pouches 30 are canvas and others are plastic.

The plurality of large inverted U-shaped loops 40 are secured within the first section 14 of the bag portion 12. The loops 40 are adapted for holding bottles 42. The loops 40 provided allow for different sized bottles to be held therein so as to maintain the bottles in an upright orientation.

The plurality of small inverted U-shaped loops 44 are secured within the first section 14 of the bag portion 12. The small loops 44 are adapted for holding toothbrushes 46 and make-up brushes.

The light 48 is secured within the second section 16 of the bag portion 12. The light 48 is in communication with the cord portion 26 of the retractable power cord 22. The light 48 can be provided with a power switch so that it can be activated only when necessary despite the electrical state of the present invention.

The mirror 50 is disposed within the second section 16 of the bag portion 12.

The tissue dispenser 52 is disposed within the second section 16 of the bag portion 12. The tissue dispenser 52 could optionally be a built-in dispenser or have means for securing a box of tissues to the second section 16.

The holding clip 54 is disposed within the second section 16 of the bag portion 12. The holding clip 54 is adapted for holding a plurality of cotton swabs 56.

The folding shelf 58 is secured within the second section 16 of the bag portion 12. The shelf 58 has a first orientation essentially parallel to the second section 16 and a second orientation essentially orthogonal to the second section 16. Note FIG. 5. The folding shelf 58 is also provided with a knob 60 for manipulation thereof.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An electric accessory bag for storing a plurality of appliances and toiletries for easy use comprising, in combination:

a bag portion comprising a pair of sections hingedly coupled together, the pair of sections including a first section and a second section, the first section having a carrying handle secured to an upper end thereof, the second section having a shoulder strap secured to an upper end thereof;

a retractable power cord secured to a side wall of the first section of the bag portion, the retractable power cord having a plug end coupleable to a standard electrical outlet, the retractable power cord having a cord portion extending interiorly of the bag portion;

a power strip disposed within the first section of the bag portion, the power strip being in communication with the cord portion of the retractable power cord;

a plurality of receiving pouches disposed within the first section of the bag portion, the receiving pouches having varying sizes and shapes, the receiving pouches adapted for holding toiletries and small appliances therein;

a plurality of large inverted U-shaped loops secured within the first section of the bag portion, the loops adapted for holding bottles;

a plurality of small inverted U-shaped loops secured within the first section of the bag portion, the small loops adapted for holding toothbrushes and make-up brushes;

a light secured within the second section of the bag portion, the light being in communication with the cord portion of the retractable power cord;

a mirror disposed within the second section of the bag portion;

a tissue dispenser disposed within the second section of the bag portion;

a holding clip disposed within the second section of the bag portion, the holding clip adapted for holding a plurality of cotton swabs; and a folding shelf secured within the second section of the bag portion, the shelf having a first orientation essentially parallel to the second section and a second orientation essentially orthogonal to the second section.

2. An electric accessory bag for storing a plurality of appliances and toiletries for easy use comprising, in combination:

a bag portion comprising a pair of sections hingedly coupled together, the pair of sections including a first section and a second section, the first section having a carrying handle secured to an upper end thereof, the second section having a shoulder strap secured to an upper end thereof;

a retractable power cord secured to a side wall of the first section of the bag portion, the retractable power cord having a plug end coupleable to a standard electrical outlet, the retractable power cord having a cord portion extending interiorly of the bag portion; and a power strip disposed within the first section of the bag portion, the power strip being in communication with the cord portion of the retractable power cord.

3. The electric accessory bag as set forth in claim 2 and further including a plurality of receiving pouches disposed within the first section of the bag portion, the receiving pouches having varying sizes and shapes, the receiving pouches adapted for holding toiletries and small appliances therein.

4. The electric accessory bag as set forth in claim 2 and further including a plurality of large inverted U-shaped loops secured within the first section of the bag portion, the loops adapted for holding bottles.

5. The electric accessory bag as set forth in claim 2 and further including a plurality of small inverted U-shaped loops secured within the first section of the bag portion, the small loops adapted for holding toothbrushes and make-up brushes.

6. The electric accessory bag as set forth in claim 2 and further including a light secured within the second section of the bag portion, the light being in communication with the cord portion of the retractable power cord.

7. The electric accessory bag as set forth in claim 2 and further including a mirror disposed within the second section of the bag portion.

8. The electric accessory bag as set forth in claim 2 and further including a tissue dispenser disposed within the second section of the bag portion.

9. The electric accessory bag as set forth in claim 2 and further including a holding clip disposed within the second section of the bag portion, the holding clip adapted for holding a plurality of cotton swabs.

10. The electric accessory bag as set forth in claim 2 and further including a folding shelf secured within the second section of the bag portion, the shelf having a first orientation essentially parallel to the second section and a second orientation essentially orthogonal to the second section.

* * * * *